US009646800B2

(12) United States Patent
Matsuoka et al.

(10) Patent No.: US 9,646,800 B2
(45) Date of Patent: May 9, 2017

(54) TRAVELING WAVE TUBE SYSTEM AND CONTROL METHOD OF TRAVELING WAVE TUBE

(71) Applicant: NEC Network and Sensor Systems, Ltd., Tokyo (JP)

(72) Inventors: Junichi Matsuoka, Tokyo (JP); Junichi Kobayashi, Tokyo (JP)

(73) Assignee: NEC Network and Sensor Systems, Ltd., Tokyo (JP)

( * ) Notice: Subject to any disclaimer, the term of this patent is extended or adjusted under 35 U.S.C. 154(b) by 0 days.

(21) Appl. No.: 14/230,171

(22) Filed: Mar. 31, 2014

(65) Prior Publication Data

US 2014/0292191 A1 Oct. 2, 2014

(30) Foreign Application Priority Data

Mar. 29, 2013 (JP) ..... 2013-072209
Mar. 18, 2014 (JP) ..... 2014-054546

(51) Int. Cl.
*H01J 23/02* (2006.01)
*H01J 23/34* (2006.01)
*H01J 23/027* (2006.01)
*H01J 25/34* (2006.01)

(52) U.S. Cl.
CPC ..... *H01J 23/34* (2013.01); *H01J 23/027* (2013.01); *H01J 25/34* (2013.01)

(58) Field of Classification Search
CPC .. H01J 3/021; H01J 25/34; H01J 25/38; H01J 31/30; H01J 37/063
USPC ..... 315/1, 3.5, 94, 330, 331
See application file for complete search history.

(56) References Cited

U.S. PATENT DOCUMENTS 6,310,438 B1 * 10/2001 Tsuida ..... H01J 3/021 313/309
6,583,567 B2 * 6/2003 Tsuida ..... H01J 3/021 313/309
7,034,472 B2 * 4/2006 Kobayashi ..... H01J 23/34 315/291

(Continued)

FOREIGN PATENT DOCUMENTS

JP 02-070341 5/1990
JP 02253542 A * 10/1990 ..... H01J 37/063

(Continued)

*Primary Examiner* — Alexander H Taningco
*Assistant Examiner* — Kurtis R Bahr
(74) *Attorney, Agent, or Firm* — Wilmer Cutler Pickering Hale and Dorr LLP

(57) ABSTRACT

A traveling wave tube system includes a traveling wave tube, and a power supply device for supplying required power supply voltages to the respective electrodes of the traveling wave tube. The power supply device includes a control voltage generation circuit for generating a control voltage which is a negative DC voltage on the basis of a ground potential and supplying the control voltage to the anode, an anode voltage generation circuit for generating an anode voltage which is a negative DC voltage on the basis of the potential of the anode and supplying the anode voltage to the cathode, and a collector voltage generation circuit for generating a collector voltage which is a positive DC voltage on the basis of the potential of the cathode and supplying the collector voltage to the collector.

1 Claim, 4 Drawing Sheets

(56) References Cited

U.S. PATENT DOCUMENTS

| | | | | |
|---|---|---|---|---|
| 7,071,624 | B2 * | 7/2006 | Tsuchida | H01J 25/34 315/3.5 |
| 7,489,084 | B2 * | 2/2009 | Kobayashi | H01J 23/34 315/3.5 |
| 7,898,346 | B2 * | 3/2011 | Kobayashi | H01J 23/34 330/43 |
| 7,952,288 | B2 * | 5/2011 | Nakazato | H01J 23/34 315/3.5 |
| 8,492,978 | B2 * | 7/2013 | True | H01J 37/063 315/105 |
| 2006/0186817 | A1 * | 8/2006 | Cascone | H01J 23/0275 315/3.5 |
| 2009/0096379 | A1 * | 4/2009 | Nakazato | H01J 23/34 315/3.5 |
| 2011/0062898 | A1 | 3/2011 | True | |

FOREIGN PATENT DOCUMENTS

| | | |
|---|---|---|
| JP | 03-091816 | 4/1991 |
| JP | 2007-207496 | 8/2007 |
| JP | 2009-211872 | 9/2009 |
| JP | 2010-232045 | 10/2010 |

* cited by examiner

TRAVELING WAVE TUBE SYSTEM AND CONTROL METHOD OF TRAVELING WAVE TUBE

This application is based upon and claims the benefit of priority from Japanese patent application No. 2013-072209, filed on Mar. 29, 2013, and Japanese patent application No. 2014-054546, filed on Mar. 18, 2014, the disclosure of which is incorporated herein in its entirety by reference.

TECHNICAL FIELD

The present invention relates to a traveling wave tube system provided with a traveling wave tube and a power supply device for supplying required power supply voltages to the respective electrodes of the traveling wave tube, and to a control method of the traveling wave tube.

BACKGROUND ART

A traveling wave tube and a klystron, for example, are electron tubes used for the amplification, oscillation or the like of an RF (Radio Frequency) signal by means of interaction between an electron beam emitted from an electron gun and a high-frequency circuit. As illustrated in, for example, FIG. 1, traveling wave tube (TWT) 1 includes electron gun 10 for emitting electrons, helix 20 which is a circuit for causing an electron beam formed by the electrons emitted from electron gun 10 and an RF signal to interact with each other, collector 30 for capturing electrons output from helix 20, and anode 40 for drawing electrons from electron gun 10 and guiding the electrons emitted from electron gun 10 into the helical structure of helix 20. Electron gun 10 is provided with cathode 11 for emitting electrons (thermal electrons), and heater 12 for providing thermal energy for cathode 11 to emit electrons.

Electrons emitted from electron gun 10 are accelerated by the potential difference between cathode 11 and helix 20, while forming an electron beam, and are introduced into the helical structure of helix 20. The electrons advance within the helical structure of helix 20 while interacting with an RF signal input from one end (RF in) of helix 20. Electrons having passed through the helical structure of helix 20 are captured by collector 30. At this time, an RF signal amplified by interaction with the electron beam is output from the other end (RF out) of helix 20.

Required power supply voltages are supplied from power supply device 60 to cathode 11, heater 12, anode 40 and collector 30 of traveling wave tube 1 illustrated in FIG. 1. Helix 20 is generally connected to the case of traveling wave tube 1 and grounded.

Power supply device 60 is provided with helix voltage generation circuit 61 for generating a helix voltage (Ehel) which is a negative DC voltage on the basis of the potential (HELIX) of helix 20 and supplying the helix voltage to cathode 11, collector voltage generation circuit 62 for generating a collector voltage (Ecol) which is a positive DC voltage on the basis of the potential (H/K) of cathode 11 and supplying the collector voltage to collector 30, anode voltage generation circuit 63 for generating an anode voltage (Ea) which is a positive DC voltage on the basis of the potential (H/K) of cathode 11 and supplying the anode voltage to anode 40, and heater voltage generation circuit 64 for generating a heater voltage (Ef) which is a negative DC voltage on the basis of the potential (H/K) of cathode 11 and supplying the heater voltage to heater 12.

In the traveling wave tube system of the related art illustrated in FIG. 1, the quantity of electrons emitted from cathode 11 can be controlled by the anode voltage (Ea). It is therefore possible to control the execution and stoppage of RF signal amplifying operation by traveling wave tube 1.

Note that a technique to execute or stop an RF signal amplifying operation by an electron tube by turning on or off an electron beam is also described in, for example, US Patent Application Publication No. 2011/0062898. An on-state of the electron beam refers to a state of emitting electrons from a cathode, whereas an off-state of the electron beam refers to a state of not emitting electrons from the cathode.

In the configuration described in US Patent Application Publication No. 2011/0062898 mentioned above, a first DC voltage source (for example, 1.7 kV), a second DC voltage source (for example, 4.1 kV), and a third DC voltage source (for example, 1.7 kV) connected in series are interposed between the helix and the cathode. When the electron beam is turned on, a helix voltage of 7.5 kV (=1.7 kV+4.1 kV+1.7 kV) is applied between the helix and the cathode. When the electron beam is turned off, the anode is connected to the connection node (Ea=−1.7 kV) between the first DC voltage source and the second DC voltage source and the cathode is connected to the connection node (H/K=−5.8 kV) between the second DC voltage source and the third DC voltage source to reduce the potential difference (=4.1 kV) between the cathode and the anode.

In the traveling wave tube system of the related art illustrated in FIG. 1, a method commonly used when stopping an RF signal amplifying operation by traveling wave tube 1 is to match the potential of anode 40 to the potential (H/K) of cathode 11 in order to turn off the electron beam.

In a traveling wave tube with high perveance, however, a small quantity of electrons is emitted from cathode 11, and therefore, a marginal cathode current flows as illustrated in FIG. 2, even if anode voltage generation circuit 63 is disabled to set the anode voltage (Ea) to 0 V (Ea=H/K). Accordingly, noise (thermal noise) is observed at the output terminal (RF out) of helix 20 due to the effects of the electron beam formed by the electrons. Note that methods for setting the anode voltage (Ea) to 0 V (Ea=H/K) also include changing the anode voltage (Ea) using a switch for connecting anode 40 to helix 20 or cathode 11. The anode voltage (Ea) shown in FIG. 2 represents a positive DC voltage based on the potential (H/K) of the cathode and does not show a correct voltage value.

Methods for stopping electrons from being emitted from cathode 11 include supplying a negative voltage (normally from several volts to approximately several hundred volts) to anode 40 on the basis of the potential (H/K) of cathode 11. In that case, however, positive and negative voltages need to be generated in anode voltage generation circuit 63 described above on the basis of the potential (H/K) of cathode 11, and therefore, the configuration of anode voltage generation circuit 63 becomes complicated.

Note that US Patent Application Publication No. 2011/0062898 describes an invention that assumes an electron tube provided with a focusing electrode for focusing electrons emitted from the cathode on the vicinity thereof. US Patent Application Publication No. 2011/0062898 shows that even if a potential difference of 4.1 kV is present between the cathode and the anode, the electron beam can be turned off by applying a negative voltage (=−1.7 kV with reference to the cathode potential) greater than a voltage (=1.64 kV) obtained by multiplying the potential difference by a perveance (for example, microperveance=0.4) to the focusing electrode. That is, in US Patent Application Publication No. 2011/0062898 mentioned above, there is the need for a circuit for generating a required negative voltage on the basis of the cathode potential to supply the voltage to the focusing electrode.

SUMMARY

Therefore, it is an object of the present invention to provide a traveling wave tube system capable of controlling the execution and stoppage of an RF signal amplifying operation by a traveling wave tube with a simple circuit configuration and of reducing noise generated when an RF signal amplifying operation by the traveling wave tube is stopped, and a control method of the traveling wave tube.

In order to achieve the above-described object, a traveling wave tube system of an exemplary aspect of the present invention includes:

- a traveling wave tube; and
- a power supply device that supplies required power supply voltages to a cathode, an anode, a heater and a collector provided in the traveling wave tube, the power supply device including:

- a control voltage generation circuit that generates a control voltage which is a negative DC voltage on the basis of a ground potential and supplies the control voltage to the anode;
- an anode voltage generation circuit that generates an anode voltage which is a negative DC voltage on the basis of the potential of the anode and supplies the anode voltage to the cathode;
- a collector voltage generation circuit that generates a collector voltage which is a positive DC voltage on the basis of the potential of the cathode and supplies the collector voltage to the collector; and
- a heater voltage generation circuit that generates a heater voltage which is a required voltage on the basis of the potential of the cathode and supplies the heater voltage to the heater.

On the other hand, a traveling wave tube control method of an exemplary aspect of the present invention is a method for controlling a traveling wave tube provided with a cathode, an anode, a heater and a collector, wherein when the traveling wave tube is in normal operation, a power supply device, which generates required power supply voltages, supplies:

- a required control voltage which is a negative DC voltage to the anode on the basis of a ground potential;
- a required anode voltage which is a negative DC voltage to the cathode on the basis of the potential of the anode;
- a required collector voltage which is a positive DC voltage to the collector on the basis of the potential of the cathode; and
- a heater voltage which is a required voltage to the heater on the basis of the potential of the cathode, and
- when an RF (Radio Frequency) signal amplifying operation by the traveling wave tube is stopped, a controller causes the power supply device to stop supplying the control voltage to the anode.

The above and other objects, features, and advantages of the present invention will become apparent from the following description with reference to the accompanying drawings, which illustrate examples of the present invention.

EXEMPLARY EMBODIMENT

Next, the present invention will be described using the accompanying drawings.

Figure 3:
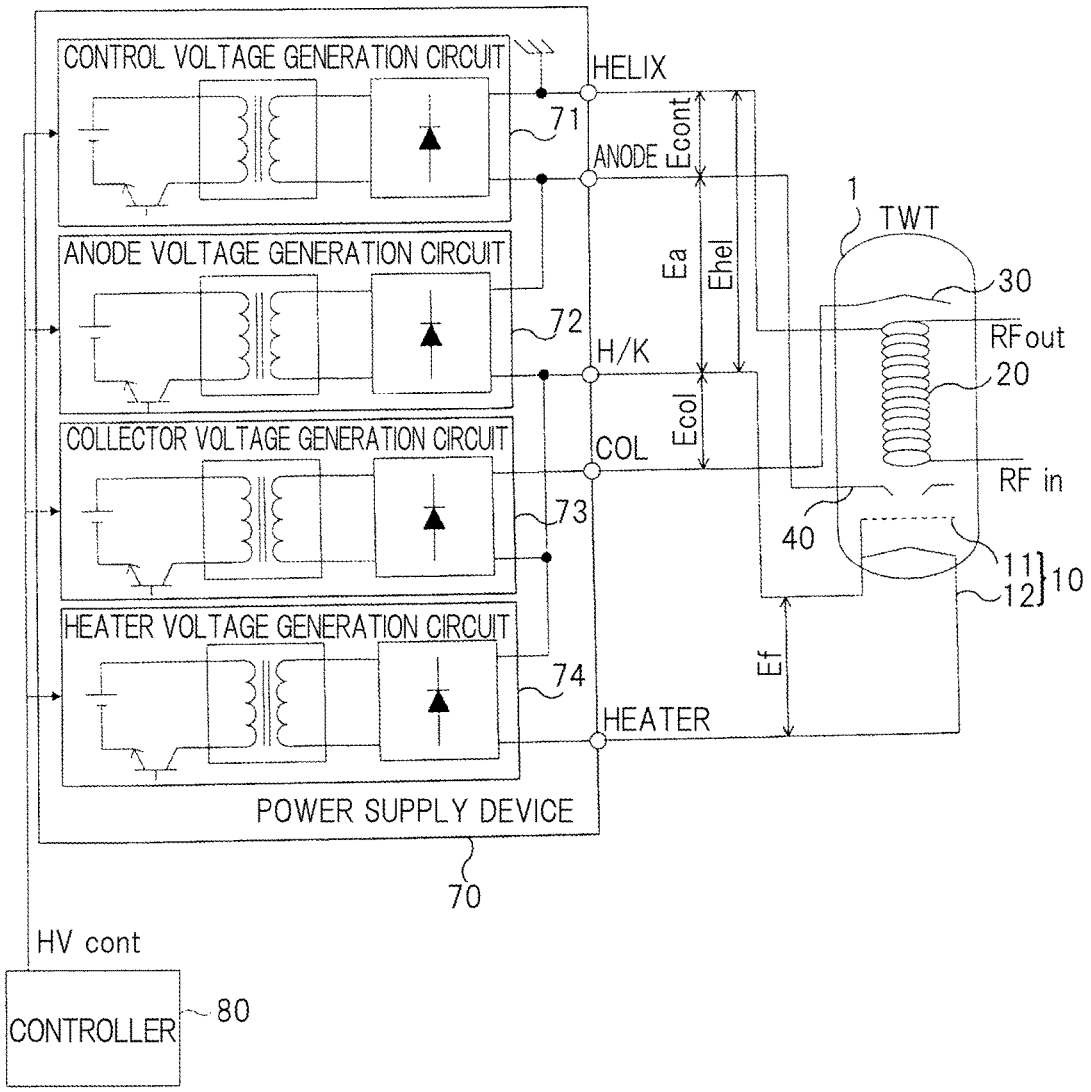
FIG. 3 is a block diagram illustrating one configuration example of a traveling wave tube system of the present invention.
Figure 4:
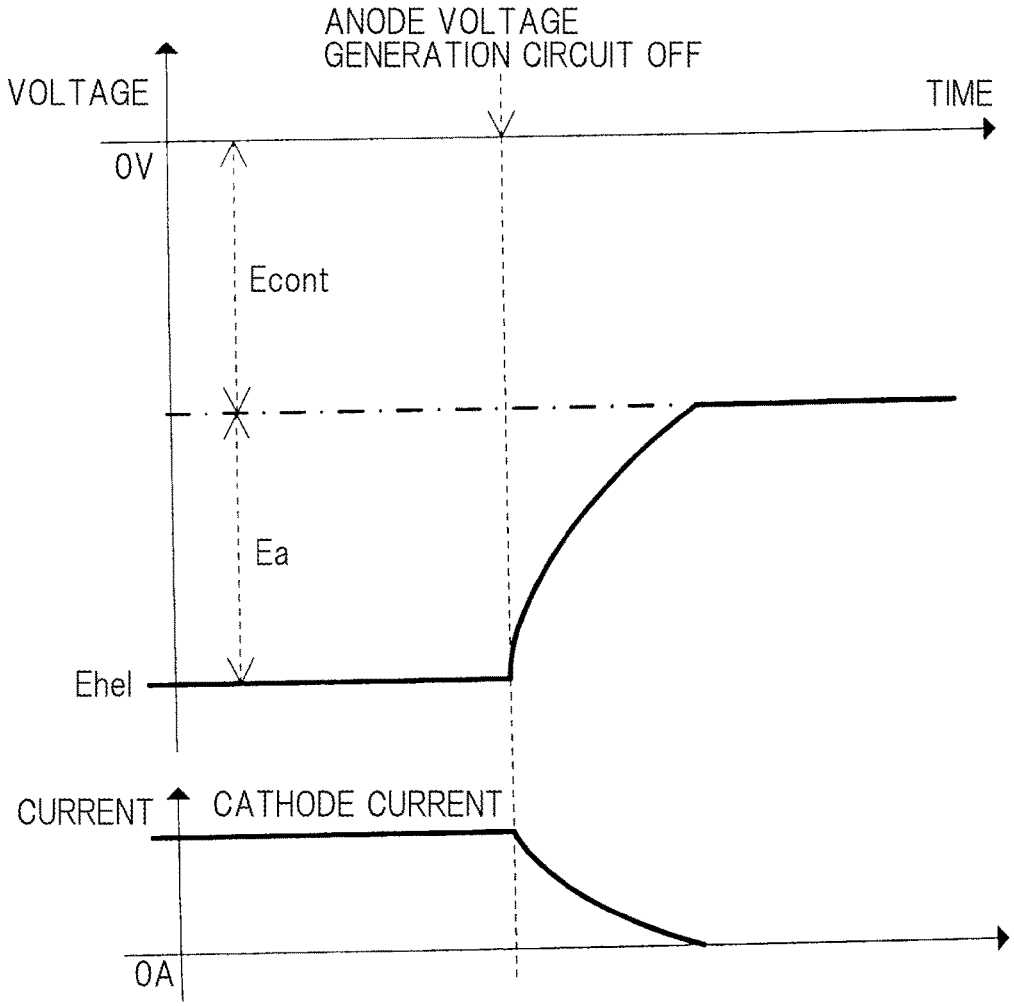
FIG. 4 is a graph showing one example of the way a helix voltage and a cathode current vary when the control voltage generation circuit illustrated in FIG. 3 is disabled.

FIG. 3 is a block diagram illustrating one configuration example of a traveling wave tube system of the present invention, whereas FIG. 4 is a graph showing one example of the way a helix voltage and a cathode current vary when the control voltage generation circuit illustrated in FIG. 3 is disabled.

As illustrated in FIG. 3, the traveling wave tube system of the present invention includes traveling wave tube 1; power supply device 70 for supplying required power supply voltages to respective electrodes (cathode 11, heater 12, anode 40 and collector 30) when the traveling wave tube 1 is in normal operation; and controller 80 for controlling the operation of power supply device 70. Helix 20 is connected to the case of traveling wave tube 1 and grounded. The configuration of traveling wave tube 1 illustrated in FIG. 3 is the same as that of traveling wave tube 1 of the related art illustrated in FIG. 1, and therefore, will not be described again here.

Power supply device 70 includes control voltage generation circuit 71 for generating a control voltage (Econt) which is a negative DC voltage on the basis of the potential (HELIX) of helix 20 and supplying the control voltage to anode 40; anode voltage generation circuit 72 for generating an anode voltage (Ea) which is a negative DC voltage on the basis of the potential of anode 40 and supplying the anode voltage to cathode 11; collector voltage generation circuit 73 for generating a collector voltage (Ecol) which is a positive DC voltage on the basis of the potential of cathode 11 and supplying the collector voltage to collector 30; and heater voltage generation circuit 74 for generating a heater voltage (Ef) which is a required voltage on the basis of the potential of cathode 11 and supplying the heater voltage to heater 12. Note that FIG. 3 illustrates a configuration example in which the traveling wave tube system is separately provided with controller 80. Alternatively, however, controller 80 may be arranged in, for example, power supply device 70.

As illustrated in FIG. 3, control voltage generation circuit 71, anode voltage generation circuit 72, collector voltage generation circuit 73 and heater voltage generation circuit 74 can respectively be realized by applying a configuration including, for example, a known inverter for inverting a DC voltage output from a DC voltage source to an AC voltage, a transformer for stepping up or down the AC voltage output from the inverter, and a rectifying circuit for converting an AC voltage output from the transformer to a DC voltage.

Controller 80 can be realized using a known information-processing device (computer) or a known information-processing IC (Integrated Circuit) provided with, for example, a memory, various logic circuits, an interface circuit for transmitting and receiving signals to and from the outside, and a CPU (Central Processing Unit) for executing processes according to a control program.

Control voltage generation circuit 71, anode voltage generation circuit 72, collector voltage generation circuit 73 and heater voltage generation circuit 74 are configured to allow themselves to be enabled and disabled separately by a control signal (HV cont) supplied from controller 80. In order to disable control voltage generation circuit 71, anode voltage generation circuit 72, collector voltage generation circuit 73 or heater voltage generation circuit 74, the DC voltage source, for example, may be disabled by the control signal (HV cont) or a switching transistor provided in the inverter may be maintained in an off-state.

FIG. 3 illustrates a configuration example in which traveling wave tube 1 is provided with one collector 30. In another configuration, however, traveling wave tube 1 is provided with a plurality of collectors 30. In that case, power supply device 70 may be provided with a plurality of collector voltage generation circuits 73 for supplying required collector voltages (Ecol) to respective collectors 30. FIG. 3 also illustrates a configuration example in which a negative DC voltage is supplied to heater 12 on the basis of the potential of cathode 11. Alternatively, however, a positive DC voltage may be supplied to heater 12 on the basis of a cathode voltage, or a required AC voltage may be supplied to heater 12.

As illustrated in FIG. 3, in the traveling wave tube system of the present invention, a control voltage (Econt) which is a negative DC voltage is generated on the basis of a ground potential by control voltage generation circuit 71 provided in power supply device 70 and supplied to anode 40. In addition, an anode voltage (Ea) which is a negative DC voltage is generated on the basis of the potential of anode 40 by anode voltage generation circuit 72 and supplied to cathode 11.

Anode voltage generation circuit 72 generates a voltage in which the anode voltage (Ea) is superimposed (built up) on the control potential (Econt). The anode voltage (Ea) may be set to the difference between helix voltage (Ehel) and the control voltage (Econt), so that the required helix voltage (Ehel) is applied between helix 20 and cathode 11 when traveling wave tube 1 is in normal operation.

Collector voltage generation circuit 73 generates a collector voltage (Ecol) which is a positive DC voltage on the basis of the potential of cathode 11 and supplies the collector voltage to collector 30. Heater voltage generation circuit 74 generates a heater voltage (Ef) which is a negative (or positive) DC voltage on the basis of the potential of cathode 11 and supplies the heater voltage to heater 12.

In the traveling wave tube system of the present invention, anode voltage generation circuit 72 is disabled (shut down) as instructed by controller 80 when an RF signal amplifying operation by traveling wave tube 1 is stopped, thereby setting the output voltage (anode voltage (Ea)) of anode voltage generation circuit 72 to 0 V. That is, in order to stop an RF signal amplifying operation by traveling wave tube 1, the voltage between the helix and the cathode (helix voltage (Ehel)) is lowered (brought closer to the ground potential) by as much as the anode voltage (Ea).

Incidentally, in order to cause an electron beam and an RF signal to interact with each other within the above-described helical structure of helix 20 provided in traveling wave tube 1, the velocity of electrons and the phase velocity of the RF signal need to be made almost equal to each other.

The velocity of the RF signal which propagates in vacuum while advancing straight is almost equal to the velocity of light. On the other hand, the velocity of electrons flowing between two electrodes in vacuum does not reach the light velocity even if the potential difference between the electrodes is made larger.

Hence, in traveling wave tube 1, the RF signal is propagated through spiral helix 20 to bring the phase velocity of the RF signal in the axial direction of helix 20 closer to the velocity of electrons advancing within the helical structure.

In helix 20, a high-frequency electric field is generated by the RF signal, and electrons made incident into the helical structure of helix 20 are decelerated or accelerated by the high-frequency electric field (velocity modulation). If the velocity of electrons advancing within the helical structure and the phase velocity of the RF signal are absolutely equal to each other, the quantity of decelerated electrons and the quantity of accelerated electrons are also equal to each other. Since no interaction therefore takes place between the electron beam and the RF signal, the RF signal is not amplified. On the other hand, if the system is set so that the velocity of electrons advancing within the helical structure is slightly greater than the phase velocity of the RF signal, a dense electron group arises in a decelerated electrons' region of the high-frequency electric field generated by the RF signal. In this decelerated electrons' region, electrons are decelerated and the difference of kinetic energy between the velocity after deceleration and the initial velocity is converted into high-frequency energy. The high-frequency electric field generated by the RF signal is intensified in this way. The intensified high-frequency electric field facilitates the velocity modulation of electrons, thereby further intensifying the high-frequency electric field generated by the RF signal. This interaction takes place continuously along with the advancement of the electron beam and the RF signal. Consequently, the energy of the RF signal increases as the RF signal comes closer to the output end (RF out) of helix 20. As a result, the RF signal input from one end (cathode 11 side: RF in) of helix 20 is amplified and output from the other end (collector 30 side: RF out).

Accordingly, in traveling wave tube 1, the helical period of helix 20 which is the helical structure, the velocity of electrons (i.e., helix voltage (Ehel)), and the like are set so that the RF signal interacts with the electron beam.

Figure 1:
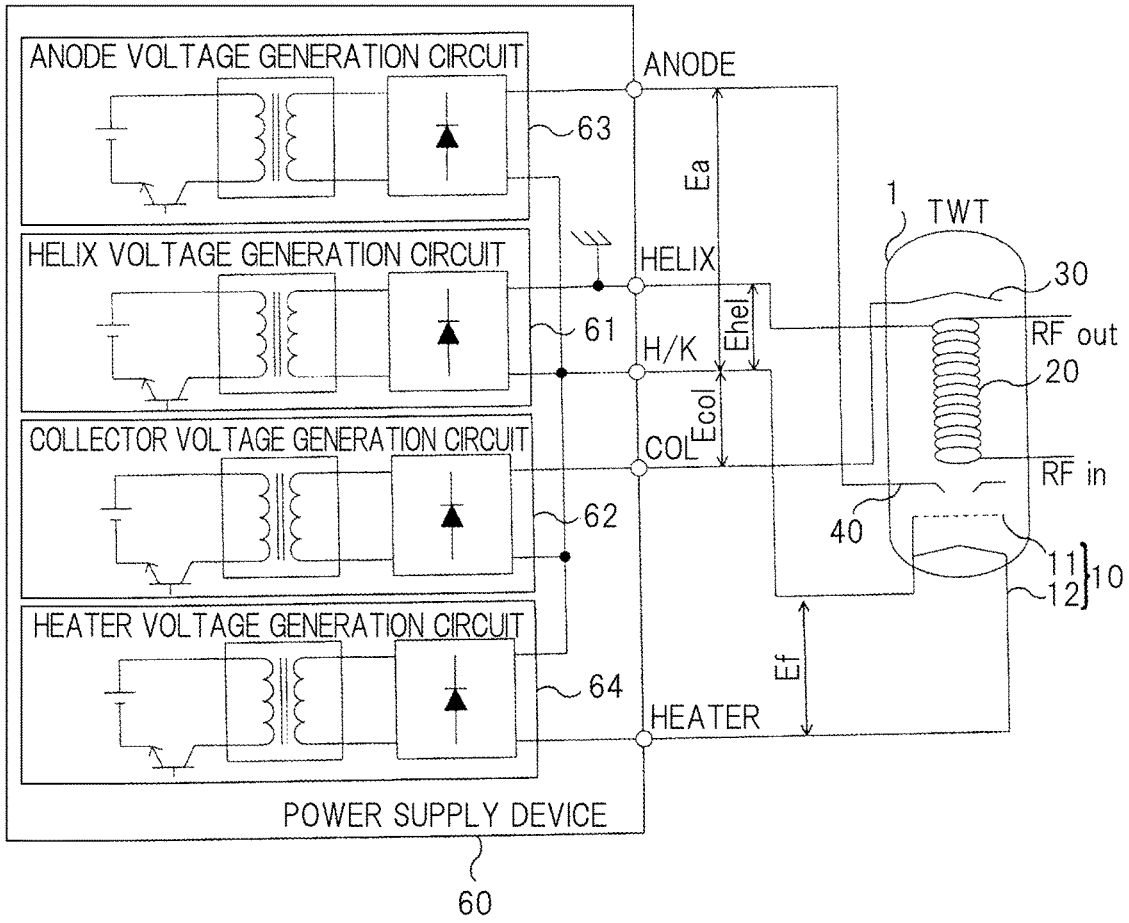
FIG. 1 is a block diagram illustrating a configuration example of a traveling wave tube system of the related art.
Figure 2:
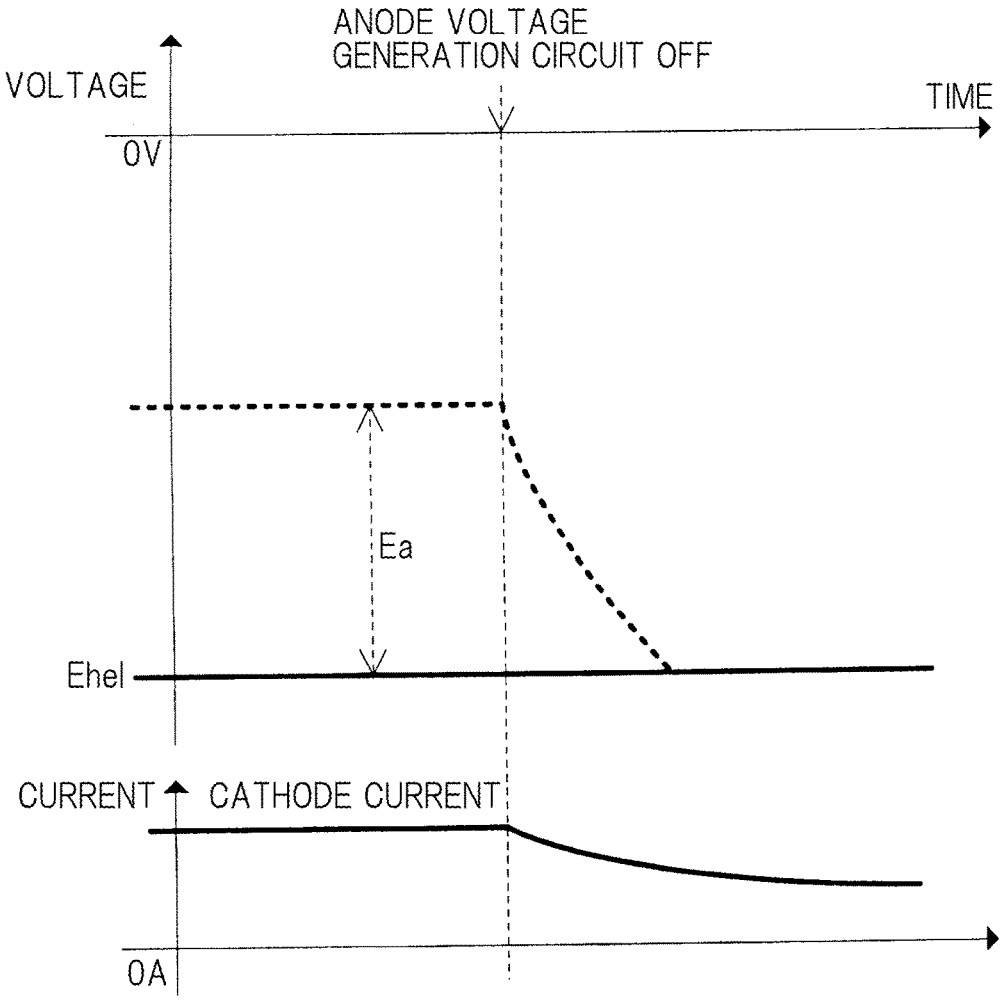
FIG. 2 is a graph showing the way a helix voltage and a cathode current vary when the anode voltage generation circuit illustrated in FIG. 1 is disabled.

In the traveling wave tube system of the related art illustrated in FIG. 1, the required helix voltage (Ehel) is applied to cathode 11 on the basis of the potential (ground potential) of helix 20 even if the anode voltage (Ea) is set to 0 V (Ea=H/K). Accordingly, even if electrons emitted from cathode 11 is small in quantity, a high-frequency component (high-frequency component of thermal noise) on helix 20 interacts with an electron beam formed by the electrons and is amplified. The component is thus observed as the above-mentioned noise.

On the other hand, in the traveling wave tube system of the present invention illustrated in FIG. 3, the voltage (helix voltage (Ehel)) between the helix and the cathode decreases to the control voltage (Econt), as illustrated in FIG. 4, when anode voltage generation circuit 72 is disabled. Thus, the velocity of the electron beam decreases. As a result, the interaction between the electron beam and the high-frequency component on helix 20 weakens. That is, the gain of traveling wave tube 1 with respect to the RF signal becomes lower, and therefore, noise that arises when RF signal amplifying operation is stopped is also reduced.

The gain of traveling wave tube 1 can be made lower by setting the control voltage (Econt) to a lower level. It is also possible to prohibit electrons from being emitted from cathode 11 by setting the control voltage (Econt) low to some degree. In that case, it is possible to eliminate noise that is caused by the electron beam when the amplifying operation of traveling wave tube 1 is stopped.

Note however that the abovementioned helix voltage (Ehel) needs to be applied between helix 20 and cathode 11 during the normal operation of traveling wave tube 1. Accordingly, when the control voltage (Econt) is set low, the value of the anode voltage (Ea) generated at anode voltage generation circuit 72 needs to be set proportionally high.

In the present invention, the control voltage (Econt) may be set so that noise that is caused by the electron beam when the amplifying operation of traveling wave tube 1 is stopped falls within an allowable range, and the anode voltage (Ea) generated at anode voltage generation circuit 72 may be set according to the control voltage (Econt). In that case, it is possible to control the execution and stoppage of an RF signal amplifying operation by traveling wave tube 1 at a voltage lower than the anode voltage of the related art.

In addition, in the present invention, the execution and stoppage of an RF signal amplifying operation by traveling wave tube 1 is controlled by enabling and disabling anode voltage generation circuit 72. Accordingly, there is no need to provide either a switch for changing the anode voltage (Ea) by connecting anode 40 to helix 20 or cathode 11, or anode voltage generation circuit 63 or the like for generating positive and negative voltages on the basis of the potential (H/K) of cathode 11, as in the related art.

Consequently, it is possible to control the execution and stoppage of an RF signal amplifying operation by traveling wave tube 1 with a simple circuit configuration.

While the invention has been particularly shown and described with reference to exemplary embodiments thereof, the invention is not limited to these embodiments. It will be understood by those ordinarily skilled in the art that various changes in form and details may be made therein without departing from the spirit and scope of the present invention as defined by the claims.

The invention claimed is:

1. A traveling wave tube system comprising:

a traveling wave tube; and a power supply device that supplies required power supply voltages to a cathode, an anode, a heater, and a collector provided in said traveling wave tube, said power supply device including:

a control voltage generation circuit that generates a control voltage which is a negative DC voltage on the basis of a ground potential and supplies the control voltage to the anode, an anode voltage generation circuit that generates an anode voltage which is a negative DC voltage on the basis of the potential of the anode and supplies the anode voltage to the cathode, a collector voltage generation circuit that generates a collector voltage which is a positive DC voltage on the basis of the potential of the cathode and supplies the collector voltage to the collector, and a heater voltage generation circuit that generates a heater voltage which is a required voltage on the basis of the potential of the cathode and supplies the heater voltage to the heater; and a controller that brings said anode voltage to 0 volts by disabling the anode voltage generation circuit when an RF (Radio Frequency) signal amplifying operation by said traveling wave tube is stopped.

* * * * *